US010344450B2

(12) United States Patent
Sharp et al.

(10) Patent No.: US 10,344,450 B2
(45) Date of Patent: Jul. 9, 2019

(54) OBJECT DETECTION SYSTEM AND METHOD

(71) Applicant: The Charles Machine Works, Inc., Perry, OK (US)

(72) Inventors: Richard F. Sharp, Perry, OK (US); Michael Avitabile, Blacksburg, VA (US); Ryan Chilton, Blacksburg, VA (US); Benjamin Hastings, Christiansburg, VA (US); David C. Conner, Newport News, VA (US)

(73) Assignee: The Charles Machine Works, Inc., Perry, OK (US)

( * ) Notice: Subject to any disclaimer, the term of this patent is extended or adjusted under 35 U.S.C. 154(b) by 79 days.

(21) Appl. No.: 15/364,808

(22) Filed: Nov. 30, 2016

(65) Prior Publication Data

US 2017/0191243 A1 Jul. 6, 2017

Related U.S. Application Data

(60) Provisional application No. 62/261,402, filed on Dec. 1, 2015.

(51) Int. Cl.
*E02F 5/06* (2006.01)
*E02F 5/14* (2006.01)
(Continued)

(52) U.S. Cl.
CPC ..... *E02F 5/145* (2013.01); *E02F 5/06* (2013.01); *E02F 9/2033* (2013.01); *E02F 9/24* (2013.01); *E02F 9/261* (2013.01); *E02F 9/262* (2013.01)

(58) Field of Classification Search
CPC . E02F 5/145; E02F 5/06; E02F 9/2025; E02F 9/24; E02F 9/261; E02F 9/262
(Continued)

(56) References Cited

U.S. PATENT DOCUMENTS 4,509,126 A 4/1985 Olig et al.
4,776,750 A 10/1988 Griswold, Jr. et al.
(Continued)

OTHER PUBLICATIONS

Diesel Progress North American Edition, "Remote Control Compaction", web page, Mar. 2005, 1 page.
(Continued)

*Primary Examiner* — Krishnan Ramesh
(74) *Attorney, Agent, or Firm* — Tomlinson McKinstry, PC

(57) ABSTRACT

A detection system used to alert an operator of a work machine of humans or objects dangerously close to the machine or a work tool attached to the machine. The detection system uses one or more cameras to capture images of an area surrounding the machine. The captured images are displayed on an interface electronically connected to a processor. Prior to operation, one or more zones surrounding the work tool or work machine are defined and projected on the images displayed on the interface. The processor analyzes the images captured by the cameras and determines if a characteristic of a predetermined object is within one or more of the identified zones. If the processor determines the characteristic of the predetermined object is within one of the zones, the processor will identify the object on the display and trigger a warning system to alert to the operator to take necessary precautions.

18 Claims, 10 Drawing Sheets

(51) Int. Cl.
*E02F 9/20* (2006.01)
*E02F 9/24* (2006.01)
*E02F 9/26* (2006.01)

(58) Field of Classification Search
USPC ..... 701/50
See application file for complete search history.

(56) References Cited

U.S. PATENT DOCUMENTS 4,784,421 A 11/1988 Alvite'
4,956,790 A 9/1990 Tsuchihashi et al.
5,046,022 A 9/1991 Conway et al.
5,150,452 A 9/1992 Pollack et al.
5,198,800 A 3/1993 Tozawa et al.
5,524,368 A 6/1996 Struck et al.
5,570,992 A 11/1996 Lemelson
5,713,419 A 2/1998 Kaczmarski et al.
5,823,707 A 10/1998 Lodovico
5,939,986 A 8/1999 Schiffbauer et al.
5,954,143 A 9/1999 McCabe et al.
5,956,250 A 9/1999 Gudat et al.
5,957,213 A 9/1999 Loraas et al.
6,061,617 A 5/2000 Berger et al.
6,479,960 B2 11/2002 Nakai et al.
6,563,430 B1 5/2003 Kemink et al.
6,614,721 B2 9/2003 Bokhour
6,647,328 B2 11/2003 Walker
6,662,881 B2 12/2003 Domann
6,708,385 B1 3/2004 Lemelson
6,784,800 B2 8/2004 Orzechowski
6,810,353 B2 10/2004 Schiffbauer
6,845,311 B1 1/2005 Stratton et al.
6,871,712 B2 3/2005 Koch et al.
6,921,317 B2 7/2005 Wood et al.
6,923,285 B1 8/2005 Rossow et al.
6,963,278 B2 11/2005 Frame
7,062,381 B1 6/2006 Rekow et al.
7,079,931 B2 7/2006 Sahm et al.
7,081,606 B2 7/2006 Osaragi et al.
7,268,700 B1 9/2007 Hoffberg
7,353,089 B1 4/2008 McEvoy
7,379,790 B2 5/2008 Toth et al.
7,400,959 B2 7/2008 Price et al.
7,863,848 B2 1/2011 Sjoberg
7,890,235 B2 2/2011 Self et al.
8,498,788 B2 * 7/2013 Kondekar ..... A01B 69/00 701/445
2003/0109960 A1 6/2003 Nourbackhsh et al.
2003/0208302 A1 11/2003 Lemelson et al.
2004/0049324 A1 3/2004 Walker
2004/0102135 A1 * 5/2004 Wood ..... B24B 19/06 451/5
2004/0158355 A1 * 8/2004 Holmqvist ..... G05D 1/0236 700/245
2004/0193323 A1 9/2004 Higaki et al.
2005/0107934 A1 5/2005 Gudat et al.
2005/0251156 A1 * 11/2005 Toth ..... G16H 40/40 606/153
2006/0074525 A1 4/2006 Close et al.
2006/0123676 A1 6/2006 Glover
2006/0124323 A1 6/2006 Glover et al.
2006/0142657 A1 6/2006 Quaid et al.
2006/0173600 A1 8/2006 Dietsch et al.
2006/0265914 A1 11/2006 Gudat
2007/0027579 A1 2/2007 Suzuki et al.
2008/0109122 A1 5/2008 Ferguson et al.
2008/0162004 A1 * 7/2008 Price ..... E02F 3/434 701/50
2008/0180523 A1 7/2008 Stratton et al.
2009/0128079 A1 5/2009 Sjoberg
2009/0259400 A1 * 10/2009 Coats ..... G01S 7/412 701/301
2010/0223008 A1 * 9/2010 Dunbabin ..... G05D 1/0274 701/301
2012/0327261 A1 * 12/2012 Tafazoli Bilandi ..... E02F 9/24 348/222.1
2014/0214237 A1 * 7/2014 Kini ..... G05D 1/0297 701/2
2014/0257647 A1 * 9/2014 Wu ..... E02F 9/24 701/50
2015/0142276 A1 * 5/2015 Wu ..... E02F 9/128 701/50
2015/0275483 A1 * 10/2015 Tsukamoto ..... E02F 9/123 701/50
2015/0343976 A1 * 12/2015 Lim ..... G01S 15/931 340/435
2017/0026618 A1 * 1/2017 Mitsuta ..... B60R 1/00
2017/0284069 A1 * 10/2017 Machida ..... E02F 9/261
2017/0298595 A1 * 10/2017 Machida ..... E02F 9/26
2018/0277067 A1 * 9/2018 Tentinger ..... A01B 69/001
2018/0354412 A1 * 12/2018 Ogihara ..... B60Q 1/34

OTHER PUBLICATIONS

NBB Controls & Components AG, "Radiokey®", web page, 1 page, Set. 2006.
Terry Costlow, "Communicating without drivers", Article, 5 pages, Jun. 2006.
United States Patent and Trademark Office, "Office Action Summary", dated Jun. 22, 2012, U.S. Appl. No. 13/026,438, 20 pages, Alexandria, VA.
United States Patent and Trademark Office, "Office Action Summary", dated Dec. 14, 2012, U.S. Appl. No. 13/026,438, 12 pages, Alexandria, VA.
United States Patent and Trademark Office, "Office Action Summary", dated Jul. 9, 2013, U.S. Appl. No. 13/026,438, 13 pages, Alexandria, VA.
United States Patent and Trademark Office, "Office Action Summary", dated Jan. 17, 2014, U.S. Appl. No. 13/026,438, 14 pages, Alexandria, VA.

* cited by examiner

OBJECT DETECTION SYSTEM AND METHOD

CROSS REFERENCE TO RELATED APPLICATION

This application claims the benefit of U.S. Provisional Patent Application Ser. No. 62/261,402 filed on Dec. 1, 2015, the entire contents of which are incorporated herein by reference.

FIELD

This invention relates generally to a detection system for use with a work machine to alert an operator of the work machine to humans or objects too close to the machine.

SUMMARY

The invention is directed to a detection system. The system comprises a work machine, one or more cameras, a processor, and a warning system. The cameras are configured to capture images of one or more zones surrounding the work machine. The processor is configured to analyze the images captured by the cameras and determine whether any captured image includes a characteristic of one or more predetermined objects within any one or more of the zones. The warning system is controlled by the processor. The warning system sends a warning signal to an operator of the work machine if the characteristic of the predetermined object is within any one or more of the zones.

In another embodiment, the invention is directed to a method for detecting objects near a work machine. The method comprises the steps of capturing images of one or more zones surrounding the work machine using one or more cameras and using a processor to analyze the images captured by any one or more of the cameras and determine whether any captured image includes a characteristic of one or more predetermined objects within any one or more of the zones. The method further comprises the step of automatically activating a warning system controlled by the processor if the processor determines the characteristic of any one or more of the predetermined objects is within any one or more of the zones.

DESCRIPTION OF THE PREFERRED EMBODIMENTS

Figure 1:
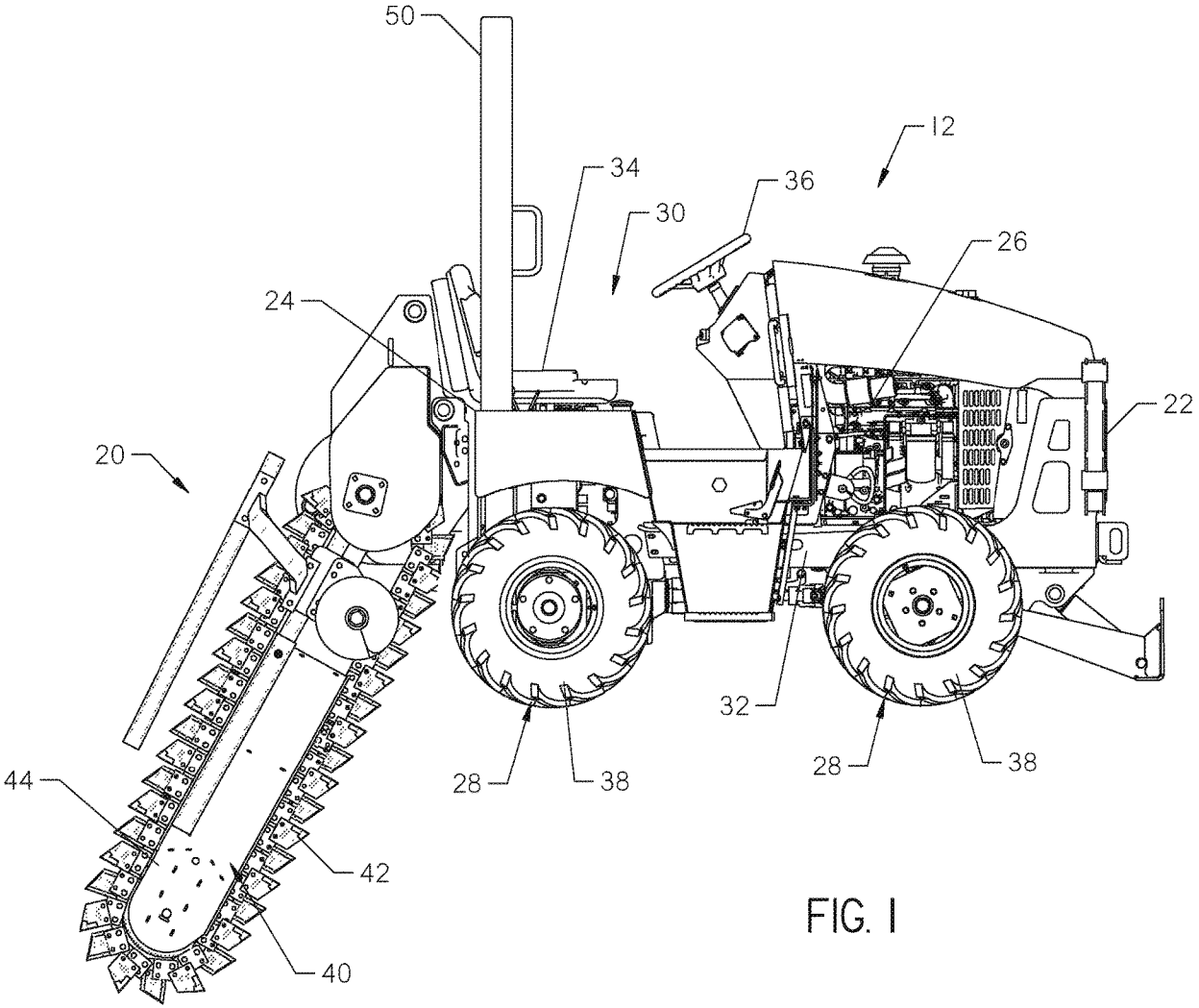
FIG. 1 is a side view of a work machine with a work tool attached.
Figure 2:
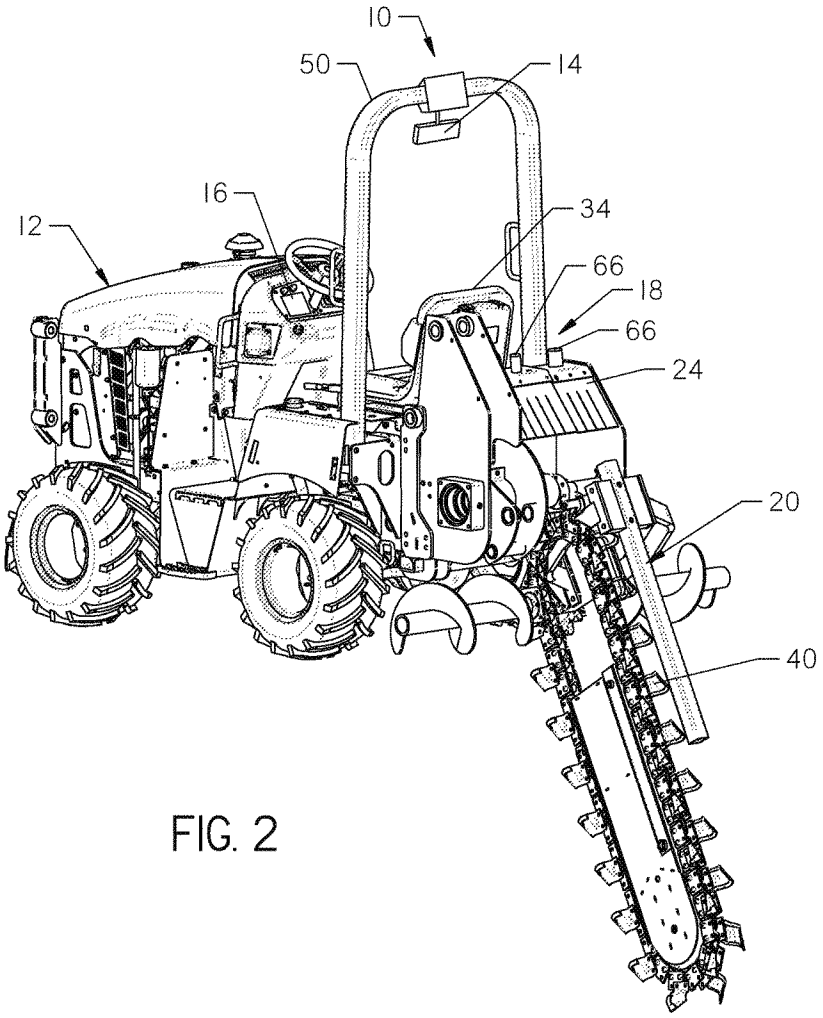
FIG. 2 is a rear perspective view of the work machine and work tool of FIG. 1 with a detection system of the present invention shown supported on the work machine.

With reference to FIGS. 1-2, a detection system 10 of the present invention comprises a work machine 12, one or more cameras 14, a processor 16, and a warning system 18. The work machine 12 comprises a work tool 20 that is attached to a front end 22 or a back end 24 of the work machine 12. When the work tool 20 is active, it is important for humans or objects to stay away from the work tool and work machine 12 to avoid injury. The detection system 10 may alert an operator of the work machine 12 of humans or objects that are dangerously close to the machine or work tool 20 during operation.

The work machine 12 further comprises an engine 26, a ground supporting member 28, and an operator station 30 situated on a frame 32. The operator station 30 shown comprises a seat 34 and steering wheel 36. Alternatively, the operator station 30 may comprise a platform and joystick controls. As a further alternative, the work machine 12 may not comprise an operator station 30 and instead may be remotely controlled or under a semi-autonomous control.

The ground supporting member 28 shown comprises a set of wheels 38. Alternatively, the ground supporting member 28 may comprise a set of endless tracks. In operation, an operator, for example, uses the steering wheel 36 to guide the wheels 38 of the work machine 12. In this way, an attentive operator will avoid objects and people. The system 10 of the present invention assists the operator in detecting unperceived or moving objects.

The work tool 20 shown is a trencher 40 that is attached to the back end 24 of the work machine 12. The trencher 40 comprises a plurality of digging teeth 42 that rotate about a trencher boom 44 to uncover a trench. Other work tools, such as vibratory plows, buckets, skid steers, excavator arms, micro-trenching assemblies, grapple arms, stump grinders, and the like may be utilized with the work machine 12.

With reference now to FIGS. 1-10, one or more of the cameras 14 are used to capture images 46 of one or more zones 48 surrounding the work tool 20 and the work machine 12. The cameras 14 may be supported on a boom 50 attached to and extending over the work machine 12, as shown in FIG. 2. This gives the cameras 14 a view of the entire work tool 20 and an area surrounding the work machine 12. Preferably, at least two cameras 14 are used and are horizontally spaced on the boom 50 to provide stereo or 3-D vision of one or more of the zones 48.

The cameras 14 may face the front end 22 or back end 24 of the work machine 12 depending on the position of the work tool 20 on the machine. Alternatively, a plurality of cameras 14 may be used to capture images of all sides of the work machine 12 if multiple work tools 20 are attached to the machine at one time. A suitable camera for use with the invention is the c-con Systems Capella model or the Leopard stereo camera module, though many different camera systems may be used.

Figure 7:
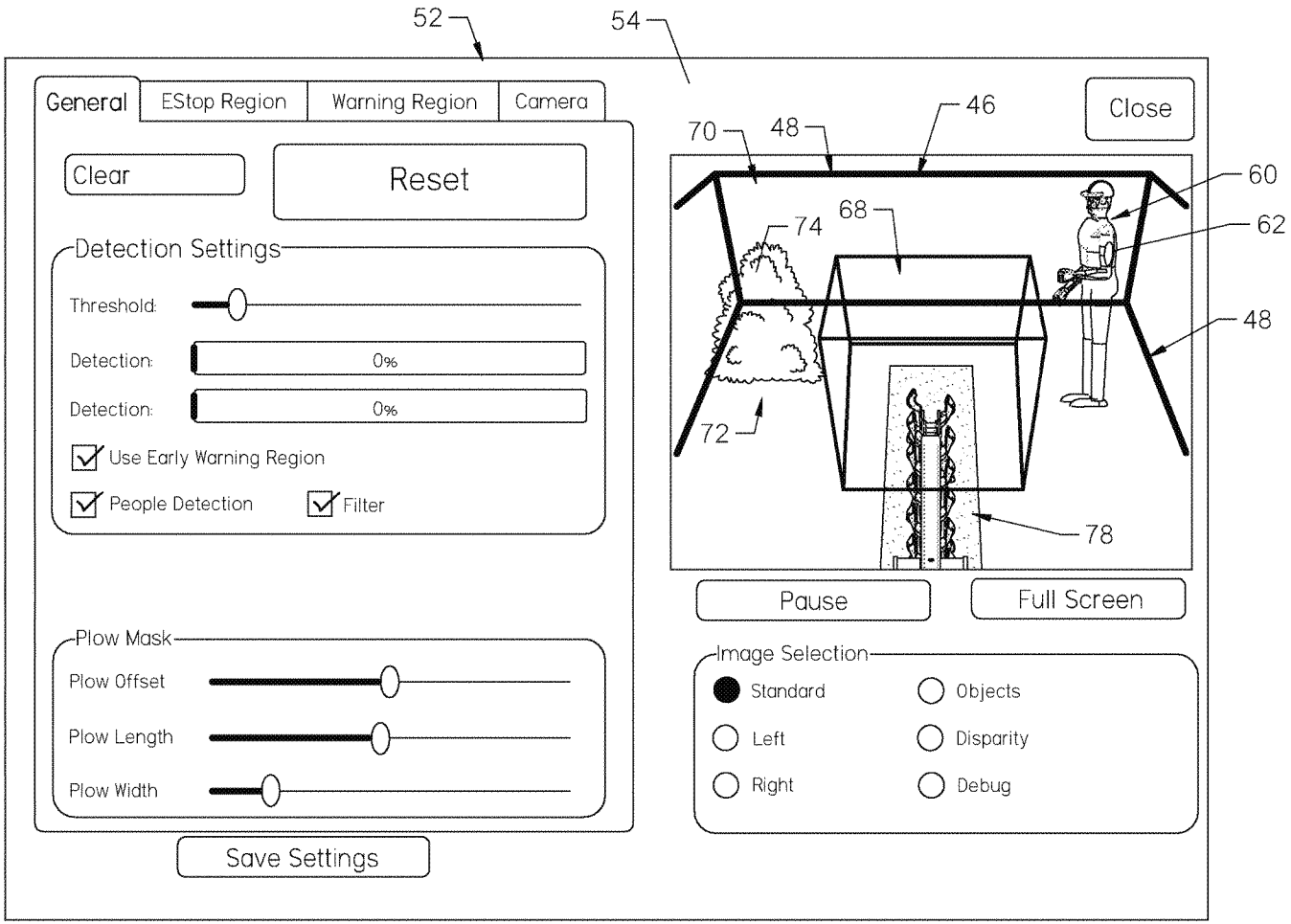
FIG. 7 is a straight on view of a display on an interface for use with the detection system.
Figure 8:
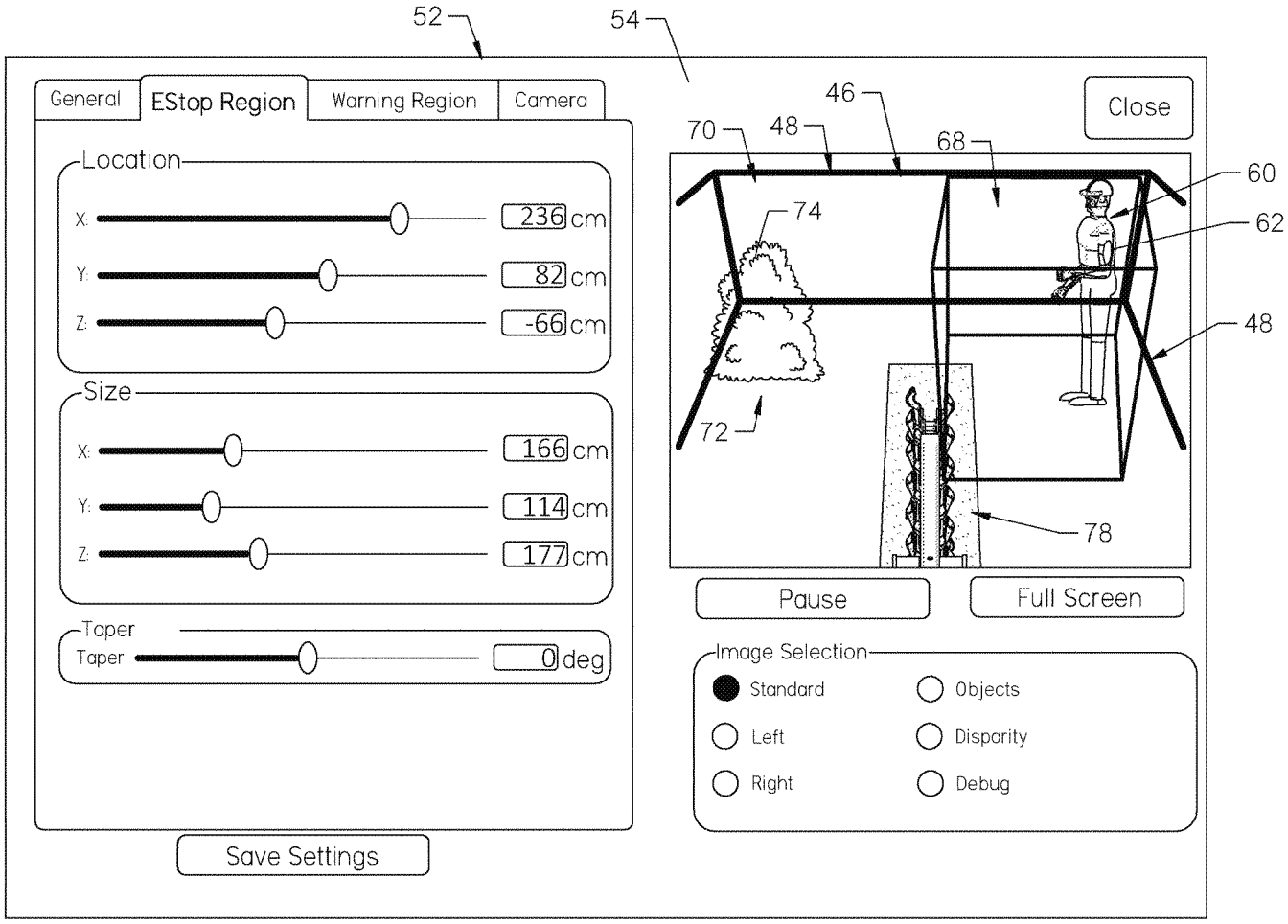
FIG. 8 is the view of FIG. 7 with an alternative display shown.
Figure 9:
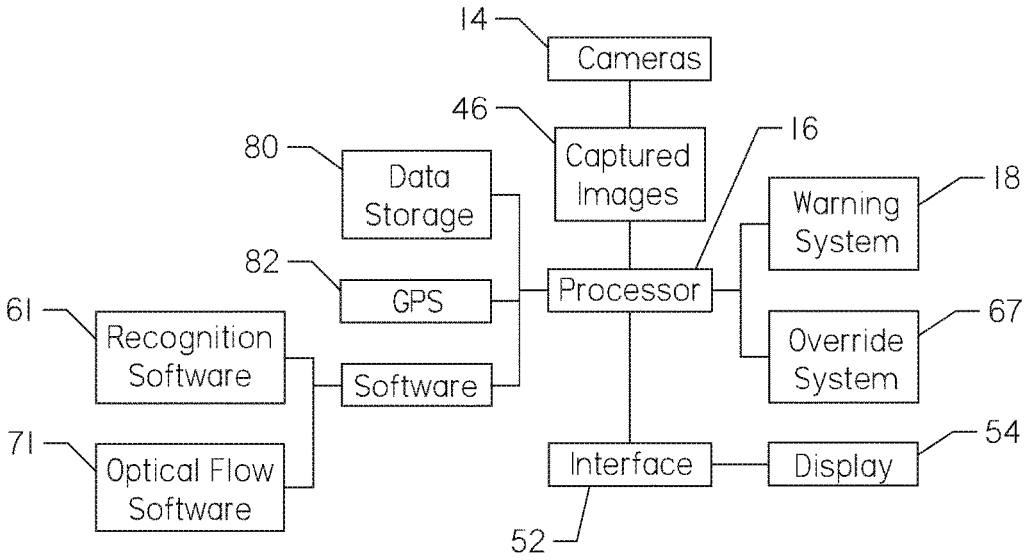
FIG. 9 is a flow chart depicting the relationship between the components of the detection system of the present invention.
Figure 10:
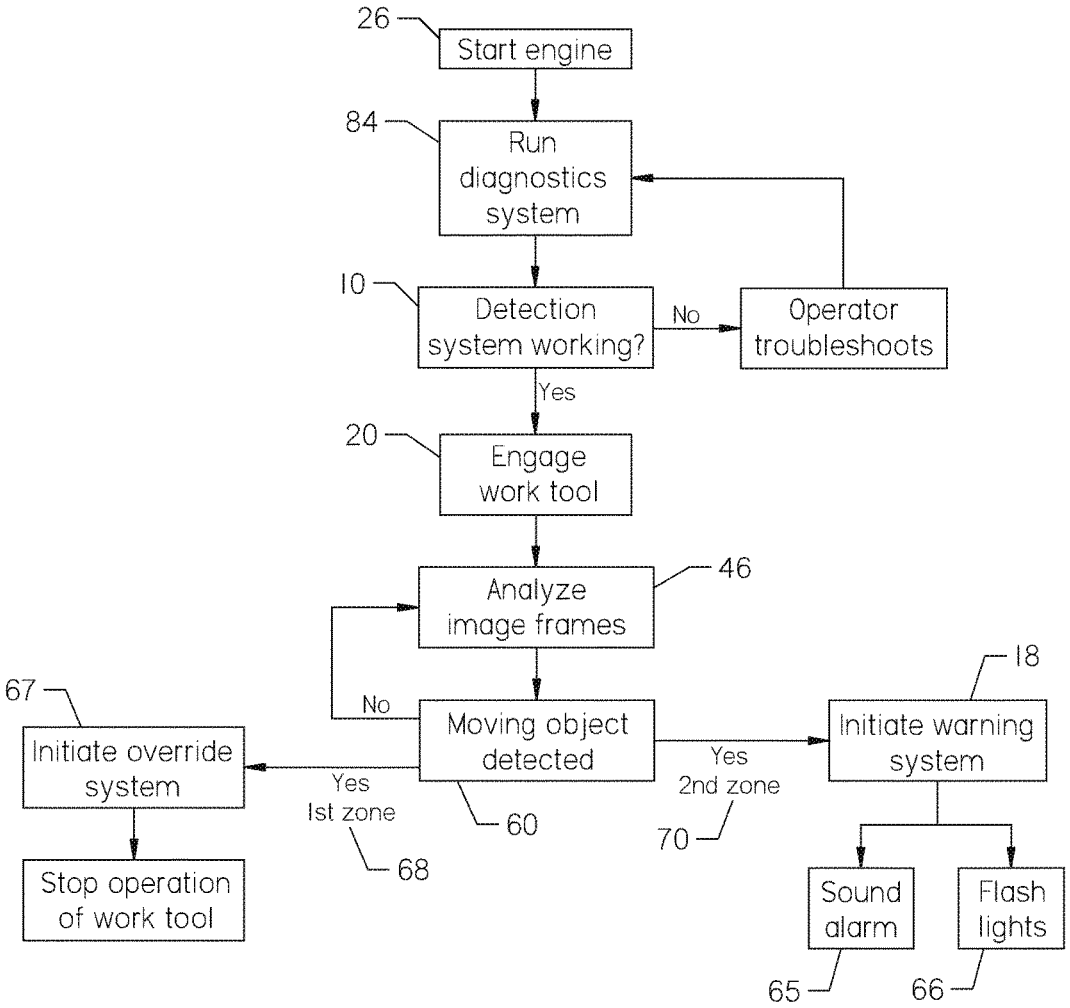
FIG. 10 is a flow chart depicting the method of operation of the detection system of the present invention.

The processor 16 may be supported on the work machine 12 at the operator station 30, as shown. Alternatively, the processor 16 may be at a location remote from the work machine 12. The processor 16 is electronically connected to an interface 52 having a display 54, as shown in FIGS. 7-9. The interface 52 may be controlled by the operator using a keyboard and mouse or a touch screen. The images 46 captured by the cameras 14 are sent to the processor 16 and depicted on the display 54. If more than one work tool 20 is attached to the machine 12, multiple images 46 may be depicted on the display 54 at one time.

Prior to operation of the work machine 12, the operator will identify one or more zones 48 surrounding the work machine 12 to be viewed by the cameras 14. The zones 48 are identified by selecting one or more boundaries 56 for each zone 48. The boundaries 56 may be defined by x, y, and z coordinates selected by the operator on the interface 52, as shown in FIG. 7. The taper of the zones 48 may also be selected by the operator on the interface 52, if any tapering is necessary to better set the size and shape of the zones.

The boundaries 56 and taper selected may form different shapes for each zone 48. The shape of the zones 48 shown are parallelepipeds, but the orientation, size, and shape of the zones may be tailored to: the clock speed or refresh rate of the detection system 10, the size of the work machine 12, the dimensions of the work tool 20, and the operator's preference. Alternatively, the zones 48 may be preselected and programmed into the processor 16 without input from the operator.

The zones 48 are projected on the display 54 overlaying the images 46 captured by the cameras 14, as shown in FIGS. 5-8. The boundaries 56 of the zones 48 are colored or shaded on the display 54. Different colors or shades may designate different zones 48. If the operator manipulates the boundaries 56 for the zones 48 on the interface 52, the changes are reflected on the display 54.

During operation, the processor 16 analyzes the images 46 captured bye the cameras 14 and determines whether any captured image includes a characteristic 58 of one or more predetermined objects 60 moving within any one of the zones 48. The predetermined object 60 shown in FIGS. 3 and 5-8 is a human form 62. Alternatively, the predetermined object 60 may be an animal form or any number of moving objects that the work tool 20 might encounter during operation, such as falling tree limbs or rocks.

The processor 16 may be programmed with recognition software 61 capable of recognizing angles of the predetermined object 60 during operation. For example, the software may be programmed to recognize angles of the human form 62. An open source computer vision library software algorithm is capable of making needed recognitions. However, other similar software may be used.

If the processor 16 determines the characteristic 58 of the predetermined object 60 is within one of the zones 48, the recognition software 61 will surround the object with a box 64 on the display 54 and highlight the recognized characteristic. The processor 16 will also trigger the warning system 18 to send a warning signal to the operator. Programming the processor 16 to recognize predetermined objects 60 reduces the likelihood of false positives interrupting operation. Otherwise, for example, debris from the work tool 20 could trigger a response initiated by the processor 16.

The warning signal may comprise an audible alarm 65 or flashing light 66, as shown in FIG. 2. The goal of the warning signal is to allow the operator time to take necessary precautions to avoid injury to the detected object 60 or anyone nearby. The processor 16 may also be programmed to automatically activate an override system 67 incorporated into the work machine 12 that stops operation of the work machine 12 or the work tool 20 if the characteristic 58 of the object 60 is within one of the zones 48. If more than one zone 48 has been identified, the response triggered by the processor 16 may vary depending on which zone the characteristic 58 of the object 60 is determined to be within.

For example, the operator may identify a first zone 68 that is an area within a predetermined distance surrounding the work tool 20, and a second zone 70 that is an area within a predetermined distance surrounding the first zone 68. Each predetermined distance may be identical or different. One predetermined distance, for example, may be about two feet.

If the characteristic 58 of the object 60 is determined to be only within the second zone 70, the processor 16 may trigger the warning system 18 to activate a warning signal. In contrast, if the characteristic 58 of the object 60 is determined to be within the first zone 68, the processor 16 may trigger the override system 67 which stops operation of the work machine 12 or work tool 20.

The specific response triggered by the processor 16 may vary depending on the operator's preference. The operator may set response preferences prior to operation using the interface 52. Alternatively, the response preferences may be pre-selected and programmed into the processor 16 without input from the operator.

Optical flow software 71 may be used with the processor 16 to determine whether the predetermined object 60 is moving into or out of the zones 48. Moving objects are seen by the software as groups of moving pixels. The location of the moving pixels on the images 46 is compared on a frame by frame basis. The frames may be compared for example at a rate of ten frames per second to identify any change in position of the moving object. This clock speed or refresh rate of the frames may be increased or decreased depending on the capabilities of the software used.

Groups of pixels in the images 46 that are determined to be moving inconsistently with the machine 12 or the ground surface are identified as moving objects and analyzed by the processor 16 to determine if the object contains a characteristic 58 of the predetermined object 60. If the moving object is determined to have a characteristic 58 of the predetermined object 60 within one of the zones 48, the processor 16 will trigger the warning system 18 and/or the override system 67. Both systems may be triggered if the predetermined object 60 moves into different zones 48.

The processor 16 may be programmed to turn off the warning system 18 or reactivate the work tool 20 or work machine 12 if it determines the object 60 has moved out of the zones 48. Alternatively, the operator may cancel activation of both the warning system 18 and/or the override system 67 if the operator determines the object 60 detected is not in any danger.

Figure 3:
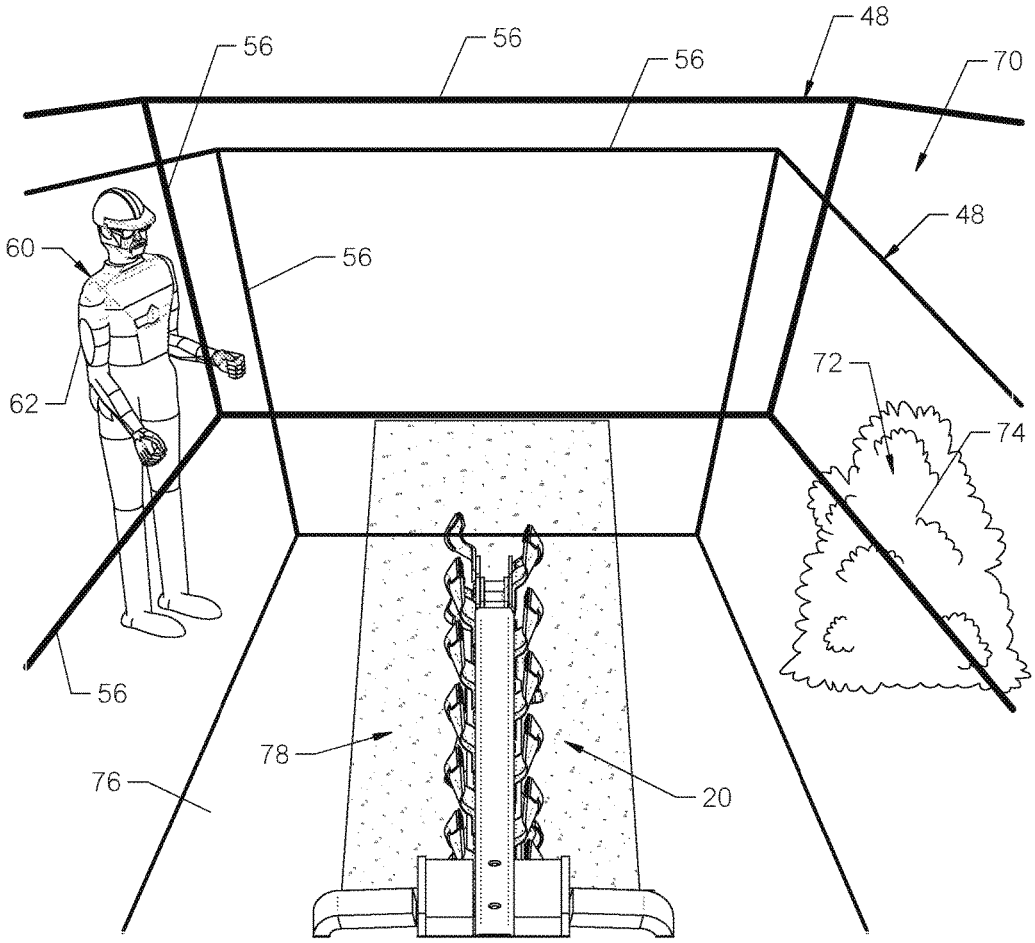
FIG. 3 is a top perspective view of the work tool of FIG. 1 and one or more zones surrounding the work tool that were identified by an operator of the work machine for analysis by the detection system.
Figure 4:
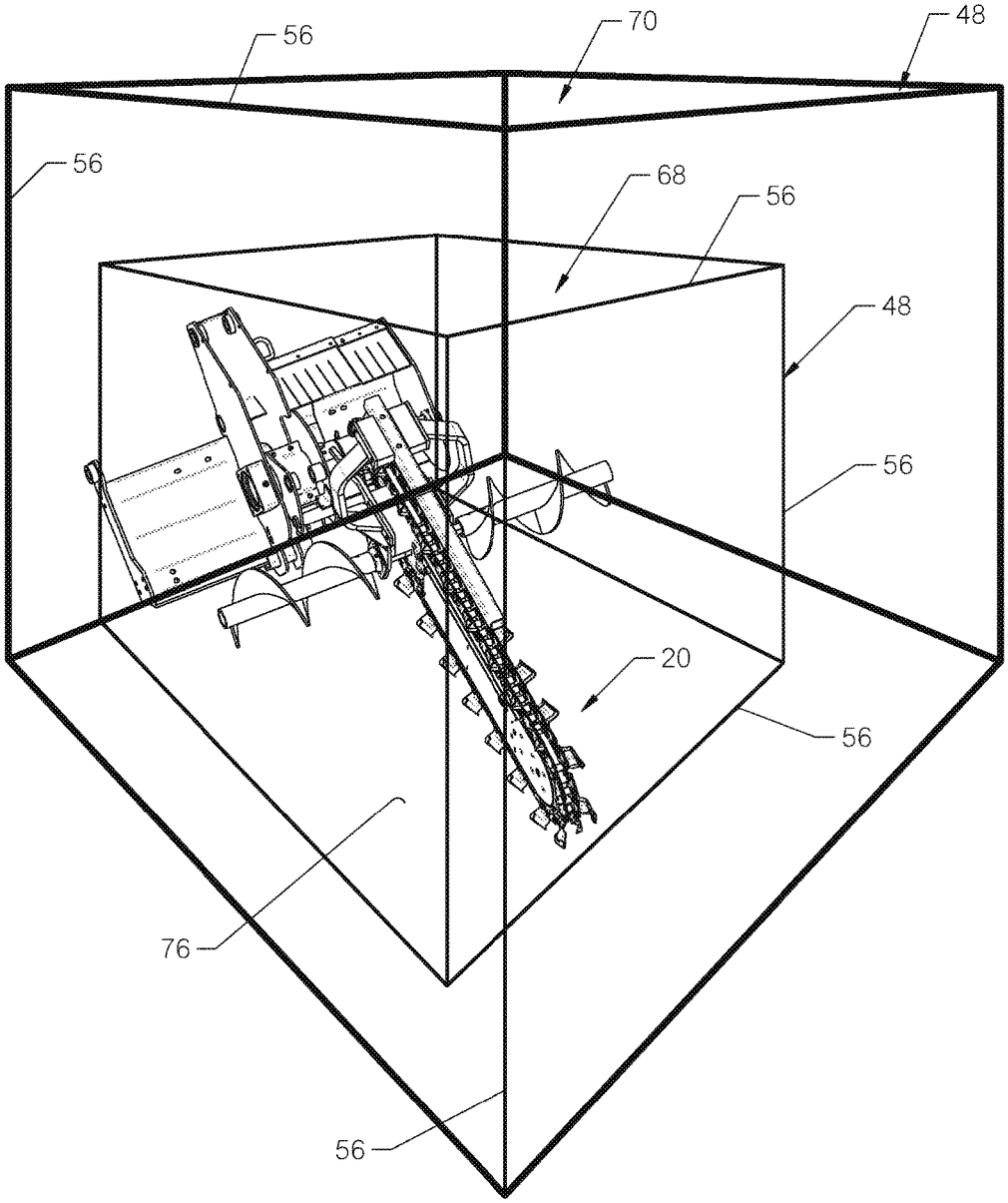
FIG. 4 is a front perspective view of FIG. 3.
Figure 5:
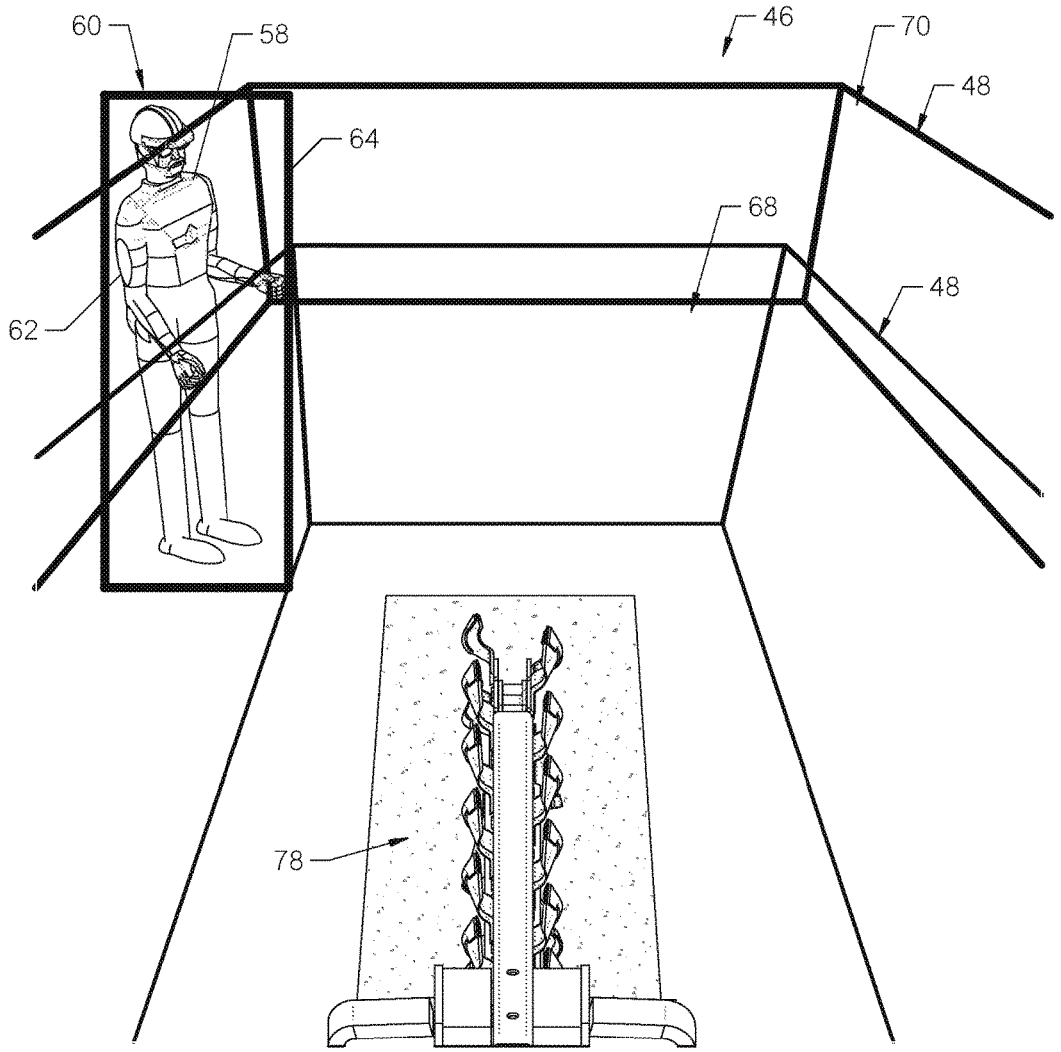
FIG. 5 is the perspective view of FIG. 3 with a human form identified in one of the zones.
Figure 6:
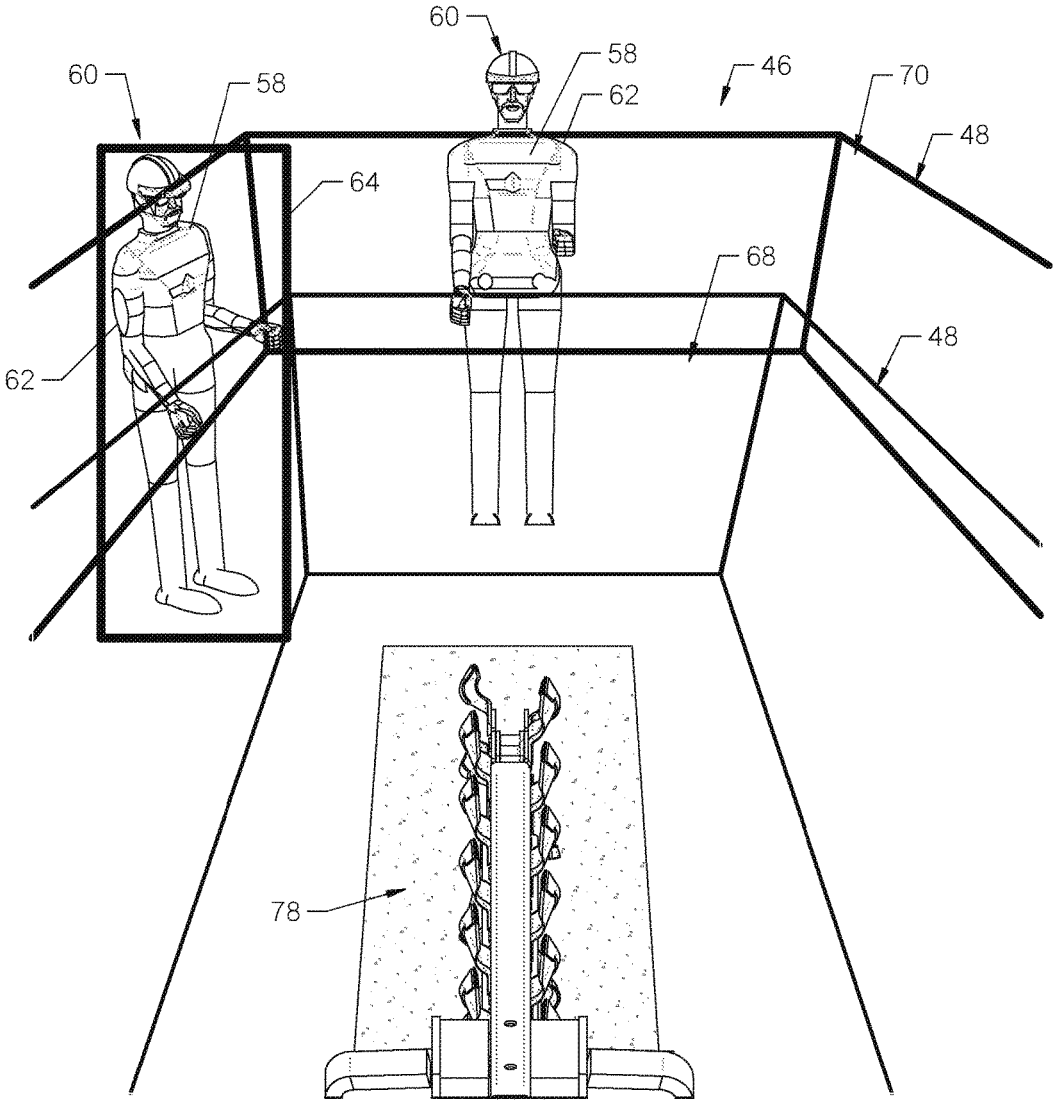
FIG. 6 is the perspective view of FIG. 5 with a second human form identified in one of the zones.

Groups of pixels in the images 46 that are determined to be moving at the same rate or direction as the ground surface are identified as stationary objects 72 the work machine 12 is moving past. For example, a bush 74 is shown in FIG. 3 as a stationary object 72 the machine is moving past. The processor 16 may be programmed to ignore stationary objects 72 when comparing frame to frame images 46.

The boundaries 56 defined for each zone 48 may include a floor 76 that is a desired distance above the ground surface. The operator can program the processor 16 to ignore any moving objects detected below the floor 76. This helps to avoid false positives from moving elements on the work tool 20 or moving dirt or cuttings that may be identified as moving objects.

Similarly, the operator may define an area immediately surrounding the work tool 20 as a black zone 78. This zone 78 may be blacked out from detection by the processor 16 to minimize false warnings and inadvertent shutdowns. The shape of the black zone 78 may be tailored to the shape and size of the work tool 20 used with the work machine 12. The size and shape of the black zone 78 may also account for the amount of debris dispersed by the work tool 20 during operation.

The level of sensitivity of the detection system 10 may be programmed by the operator on the interface 52. For example, the system 10 may be programmed such that a percentage of the predetermined object 60 must be detected within one of the zones 48 before a response is triggered by the processor 16.

The processor 16 may be programmed to include a data storage device 80, such as a memory card, to store images 46 captured of all objects 60 detected in the zones 48 during operation. GPS 82 may also be incorporated into the processor 16 to identify the physical location of the object 60 when detected in the zones 48. The processor 16 may further be equipped with a diagnostics system 84 to verify that the detection system 10 is operable each time the work machine 12 is started. If any portion of the detection system 10 is identified as being inoperable, the processor 16 may disable operation of the work tool 20 or work machine 12 until the problem is corrected.

One of ordinary skill in the art will appreciate that modifications may be made to the invention described herein without departing from the spirit of the present invention.

What is claimed is:

1. A detection system comprising:

a work machine having an operator station;

one or more cameras configured to capture images of areas surrounding the work machine;

an interface accessible to an operator of the work machine and configured to receive human input designating one or more boundaries that define one or more zones within the areas;

a processor in communication with the interface and cameras and configured to analyze the images captured by one or more of the cameras and determine whether any captured image includes a characteristic of one or more predetermined objects within any one or more of the zones;

a display configured to depict the images captured by any one or more of the cameras, in which the processor is configured to cause the display to highlight an object in a captured image having a characteristic that matches any of the one or more predetermined characteristics; and a warning system controlled by the processor that sends a warning signal to the operator if the characteristic of any one or more of the predetermined objects is within any one or more of the zones.

2. The detection system of claim 1 in which the zones are three-dimensional.

3. The detection system of claim 1 further comprising:

a work tool attached to the work machine;

in which the processor is in communication with the work tool and is configured to issue a stop command to the work tool when the processor determines that any captured image depicting any one or more of the zones includes a characteristic of one or more predetermined objects.

4. The detection system of claim 1 wherein none of the zones include an area immediately surrounding a work tool attached to the work machine.

5. The detection system of claim 1 wherein one or more of the cameras are supported on the work machine.

6. The detection system of claim 1 wherein the processor is supported on the work machine.

7. The detection system of claim 1 wherein the predetermined object is a moving object.

8. The detection system of claim 1 wherein the predetermined object is a human form.

9. The detection system of claim 1 in which the work machine is positionable at ground level, and in which the interface permits designation of a lower zone boundary spaced above the ground level.

10. The detection system of claim 1 in which the display is configured to depict one or more of the captured images in combination with a rendering of the boundaries of any portion of the zone contained within the image or images.

11. A method for detecting objects near a work machine comprising:

capturing images of one or more areas surrounding the work machine using one or more cameras;

selecting one or more boundaries for defining one or more zones within the areas on an interface in communication with the cameras and a processor;

using the processor to analyze the images captured by any one or more of the cameras and determine whether any captured image includes a characteristic of one or more predetermined objects within any one or more of the zones, in which the zone for which images are captured does not include an area immediately surrounding a work tool attached to the work machine; and automatically activating a warning system controlled by the processor if the processor determines the characteristic of any one or more of the predetermined objects is within any one or more of the zones.

12. The method of claim 11 further comprising displaying the images captured by one or more of the cameras on the interface.

13. The method of claim 12 showing an object having a characteristic that matches any of the one or more predetermined characteristics in highlighted form within a captured image on the display.

14. The method of claim 11 wherein the predetermined object is a human form.

15. The method of claim 11 wherein one or more of the cameras are supported on the work machine.

16. The method of claim 11 further comprising automatically stopping operation of a work tool attached to the work machine when any captured image depicting any one or more of the zones includes a characteristic of one or more predetermined objects.

17. The method of claim 11 further comprising automatically stopping operation of the work machine when any captured image depicting any one or more of the zones includes a characteristic of one or more predetermined objects.

18. A detection system comprising:

a work machine;

a work tool attached to the work machine;

one or more cameras configured to capture images of areas surrounding the work machine;

a processor configured to analyze the images captured by one or more cameras and determine whether any captured image includes a characteristic of one or more predetermined objects that are situated within a previously-defined three-dimensional zone within one or more of the areas, in which the previously-defined three-dimensional zone does not include an area immediately surrounding the work tool; and a warning system controlled by the processor that sends a warning signal to an operator if the characteristic of any one or more of the predetermined objects is within the previously-defined three-dimensional zone.

* * * * *